United States Patent [19]

Bobo

[11] Patent Number: 4,711,306

[45] Date of Patent: Dec. 8, 1987

[54] GAS LIFT SYSTEM

[76] Inventor: Roy A. Bobo, 3636 W. T.C. Jester, Suite B, Houston, Tex. 77018

[21] Appl. No.: 908,106

[22] Filed: Sep. 16, 1986

Related U.S. Application Data

[63] Continuation-in-part of Ser. No. 631,059, Jul. 16, 1984, abandoned.

[51] Int. Cl.[4] ..... E21B 43/00

[52] U.S. Cl. ..... 166/372; 166/267; 417/55

[58] Field of Search ..... 166/267, 372, 311, 312, 166/309; 417/54, 55, 108, 109; 175/69

[56] References Cited

U.S. PATENT DOCUMENTS

| | | | |
|---|---|---|---|
| 2,380,639 | 7/1945 | Eris | 417/55 |
| 3,215,087 | 11/1965 | McLeod | 166/372 |
| 3,653,717 | 4/1972 | Rich et al. | 417/55 |
| 3,750,753 | 8/1973 | Bernard | 166/309 |
| 3,873,238 | 3/1975 | Elfarr | 417/54 |
| 3,887,008 | 6/1975 | Canfield | 166/267 |
| 4,397,612 | 8/1983 | Kalina | 417/54 |
| 4,457,375 | 7/1984 | Cummins | 166/309 |

*Primary Examiner*—George A. Suchfield

*Assistant Examiner*—Bruce M. Kisliuk

*Attorney, Agent, or Firm*—Pravel, Gambrell, Hewitt, Kimball & Krieger

[57] ABSTRACT

The method of the present invention relates to a gas lift operation wherein pressurized injection gas is mixed with pressurized injection liquid prior to introducing the pressurized mixture into a borehole. The pressurized injection gas and liquid mixture is introduced into one portion of the well bore to a point below an initial column of well fluid present in another portion of the well bore conduit. As the mixture of injection gas and liquid travels towards the bottom of the well bore the gas is compressed more and more by the height of the column of liquid thereabove and is subsequently passed to said another portion of the well bore where the gas rises and expands to lift the oil or other well fluid to the surface. As a result of the expanding rising gas in the production conduit and the lifting of the initial charge of well fluid in the production conduit, the pressure at the lower end of the production conduit adjacent the producing formation drops, thereby inducing additional well fluid to enter said another portion of the well bore from the formation. Further injection of pressurized injection gas and liquid lifts any additional oil or other well fluid emerging from the formation to the surface.

10 Claims, 12 Drawing Figures

0
0
0
800 PSI
40
750 PSI
60
700 PSI
S
0
B
10m
60b
60c
10g
10d
60b
60c
60b
60c
DEPTH IN FEET
1000
2000
60
2500'
10m
10c
3000
10m
10c
2697'
10m
10c
10m
3500'
4000
5000
6000
7000
8000
10r
9000
$P_b$ = 2500 PSI
$P_b$ = 2500 PSI
$P_b$ = 2421 PSI
$P_b$ = 2100 PSI

INJECTION WATER
INJECTION GAS
WELL FLUID

GAS LIFT SYSTEM'

RELATED APPLICATION

This application is a continuation-in-part of U.S. patent application Ser. No. 631,059, filed July 16, 1984, now abandoned.

FIELD OF THE INVENTION

The method of the invention relates to a gas lift method for lifting well fluid from a well.

BACKGROUND OF THE INVENTION

Oil from oil bearing earth formations is produced by the inherent formation pressure. In many cases, however, the oil bearing formation lacks sufficient inherent pressure to force the oil from the formation upwardly through a string of production tubing and to the surface where it will be transported from a wellhead structure by flow lines. When the pressure of the production zone has been reduced by continued withdrawal, a time arrives when the well will not flow from its reservoir energy. When this occurs, one method of continuing production is to provide mechanical pumping operations. Another popular method for achieving production from wells that no longer are capable of natural flow is by the gas lift method whereby gas is injected into the annulus between the production tubing and the casing under controlled conditions.

The concept of using gas as a means of artificial lift of well fluids evolved in the late 1700's. The early methods were designed primarily for continuous flow operations. Continuous flow gas lift has been defined as a means of artificial lift where gas is continuously injected from the surface down the annulus defined between the tubing and the casing of a well, through a gas lift valve between the annulus and the tubing and up the tubing string. The gas mixes with and aerates the fluids in the tubing string thereby providing a lifting force for lifting the fluids to the surface. Gas was traditionally injected either around the bottom or through a piece of equipment commonly called a foot piece.

A technology developed which provided for selective injection of gas into the tubing string through gas lift valves which are well known in the art. Intermittent gas lift is a means of artificial lift where a slug or column of liquid is allowed to accumulate in the tubing string, whereupon gases are injected through a gas lift valve underneath the liquid slug to propel it to the surface in the form of a slug. U.S. Pat. No. 4,392,532 reveals such a system. A wide variety of gas lift valves have been designed specifically for intermittent lift.

Spacing and other characteristics of the gas lift valves must be established in accordance with the criteria of the particular well involved in order to achieve production at the maximum rate that is producible from the formation involved. For the reason that no two wells are exactly alike and may involve differences in such parameters as the height of the static liquid column within the well, the static gradient of the liquid fluid, i.e., liquid between the valves, and geothermal temperature, it is virtually required that each gas lift system for independent wells be separately calculated to achieve optimum production.

With both continuous and intermittent gas lift it is required that substantial volumes of gas at substantial pressures be produced at the surface of the well to achieve desired results. In addition, numerous valves are required in known systems to provide suitable pressures at the points where the gas is introduced into the tubing string. Because substantial pressures must be produced at the surface to force the substantial volumes of gas down the well for gas lift, the equipment in the form of compressors, tanks, conduits, valves and the like which is required to handle the gas is substantial and expensive.

The high pressure components of the equipment require careful maintenance to avoid expensive or dangerous failures and consume substantial quantities of energy.

Gas lift systems are usually applied to wells that produce from water driven reservoirs, or in reservoirs, which, although incapable of natural flow will have sufficient pressure throughout their life to provide the submergence required for efficient lift.

The overall efficiency of a gas lift system producing from a well with a strong water drive can be quite high. In present day systems, however, designers, faced with the necessity of unloading to the deeper depths, say to 4,000 or 5,000 feet, have resorted to use of minimum gradient curves which provide for inefficient operation. Observed efficiencies in some of these wells have ranged from seven to eleven percent.

SUMMARY OF THE INVENTION

The method of the present invention relates to a gas lift operation wherein pressurized injection gas is mixed with pressurized injection liquid to form a non-foam gas-liquid mixture which is mixed at the surface just prior to introduction into the well. The mixing pressure and the pressure of injection at the wellhead are therefore substantially equal. The pressurized injection gas and liquid mixture is introduced into the production conduit below an initial column of well fluid present in the conduit. As the mixture of injection gas and liquid travels towards the bottom of the well bore the gas is compressed and is subsequently allowed to expand when the mixture enters the production conduit. The expansion of the pressurized injection gas as it travels upwardly towards the surface in the production conduit lifts the production fluid in the conduit and thereby "unloads" the production conduit. As a result of the expanding rising gas in the production conduit and the lifting of the initial charge of well fluid in the production conduit, the pressure at the lower end of the production conduit adjacent the producing formation drops, thereby inducing additional well fluid to enter the production conduit from the formation. Further injection of pressurized injection gas and liquid lifts any additional fluid emerging from the formation and entering the production conduit. Because the gas-liquid mixture is not a foam, it can be readily separated at the surface and re-used for continuous recycling of the gas-liquid mixture.

The production conduit may be a tubing string or the annulus around the tubing string. The pressurized mixture may be introduced down the annulus, down the tubing string, or through a separate inlet pipe.

DESCRIPTION OF THE PREFERRED EMBODIMENT

Figure 1:
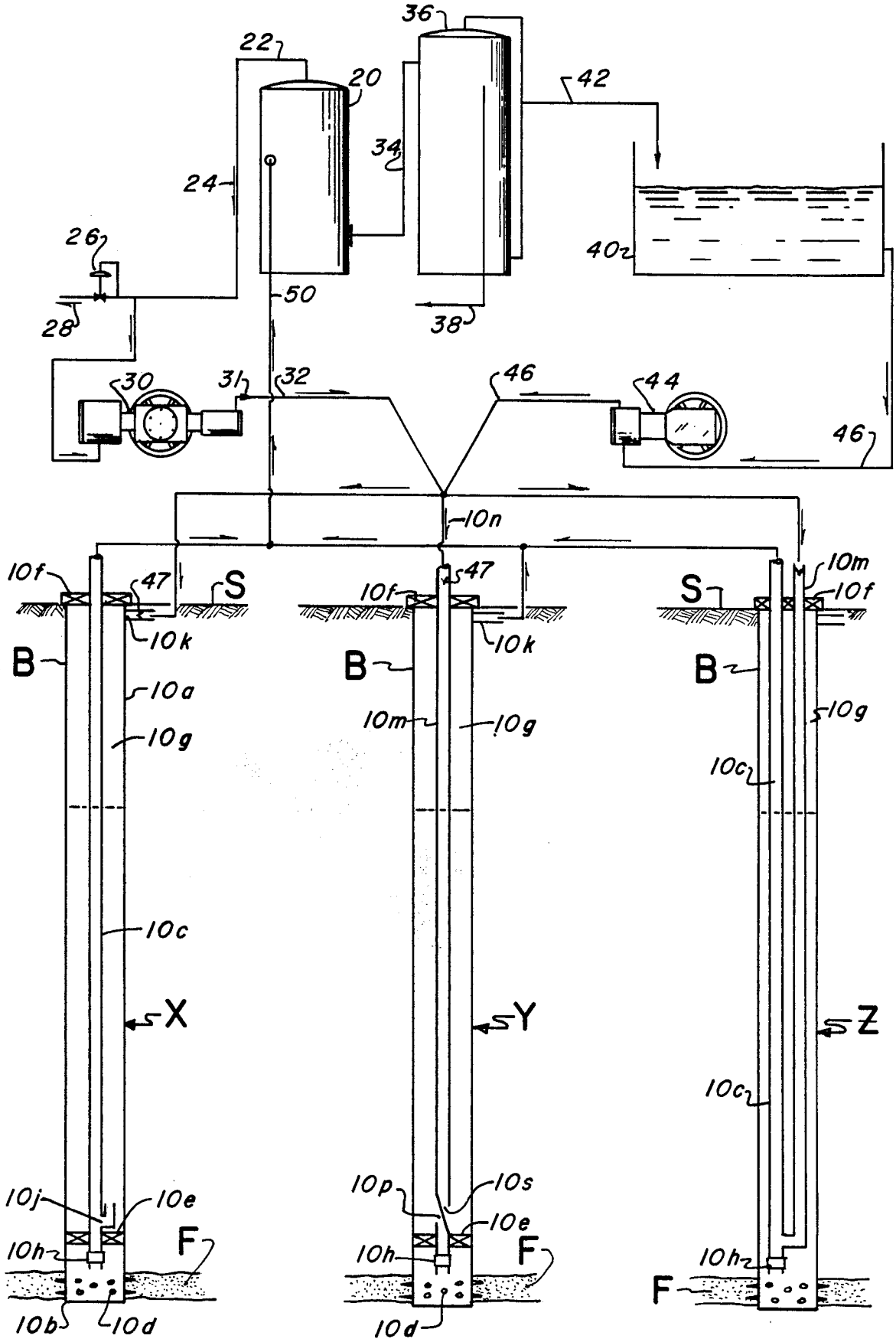
FIG. 1 represents the gas method of the present invention disclosing three alternate well bore configurations for carrying out the gas lift method.

In using the gas lift system of the present invention, FIG. 1 illustrates several types of gas lift piping arrangements within a borehole B and the associated surface equipment. Borehole B is drilled into producing formation F in a manner well known in the art. Typically a casing 10a extends from the ground surface to or through producing formation F. The casing 10a is perforated at its lower end 10b within producing formation F. A production conduit 10c is inserted into casing 10a in order to conduct well fluid 10d from producing formation F to the surface processing equipment as will be discussed in more detail hereinbelow. Typically, a packer 10e is inserted between casing 10a and production conduit 10c at the lower end of production conduit 10c. Similarly, seal 10f is disposed between casing 10a and production conduit 10c at the upper end of production conduit 10c. Packer 10e and seal 10f enclose an annulus 10g around production conduit 10c. For the purposes of gas lift, a check valve 10h is disposed at the lower end of production conduit 10c. Check valve 10h permits well fluid 10d to flow into production conduit 10c toward the upper end of production conduit 10c and prevents flow of the injection gas and liquid mixture into producing formation F as will be more fully described hereinbelow. Although check valve 10h offers advantages in using the gas lift method of the present invention, its use is not required for implementation of the gas lift method of the present invention.

As illustrated in FIG. 1, when using the gas lift method of the present invention, well fluid 10d may be brought to the surface S through production conduit 10c (embodiment X) annulus 10g (embodiment Y) or a separate injection tube 10m may extend from surface S and connect to production conduit 10c at its lower end (embodiment Z). Each embodiment employed with the gas lift method of the present invention has its own unique advantages as will be more fully described hereinbelow.

As seen in the lower left portion of FIG. 1, production conduit 10c has an opening 10j into annulus 10g adjacent packer 10e and between packers or seals 10e and 10f. Casing 10a also has an opening 10k into annulus 10g adjacent seal 10f near surface S. Injected gas and liquid are admitted as a mixture through opening 10k so that it may displace well fluid 10d initially found in annulus 10g. Annulus 10g is in flow communication with production conduit 10c adjacent packer 10e and as a result allows injected liquid and gas to flow through production conduit 10c towards port 10j thereby lifting well fluid toward surface S.

In the alternate system Y shown in the lower middle portion of FIG. 1, injection gas and liquid represented by arrow 10n are pumped into conduit 10c which is in flow communication with annulus 10g through port 10s above packer 10e. Accordingly, injection gas and liquid displace well fluid 10d through annulus 10g to the surface S through opening 10k. The well fluid enters the annulus 10g through port 10p which communicates with the formation F below the packer 10e.

Another alternate system Z shown in the right hand side of FIG. 1 is similar to the gas lift system X in that well fluids are produced out of production conduit 10c. However, rather than injecting gas and liquid into annulus 10g, an injection conduit 10m is used which is in flow communication with production conduit 10c at its lower end. Accordingly, a packer is not required at the lower end of production conduit 10c in system Z and only the usual seal 10f adjacent surface S is required.

Production fluids are processed at the surface S by a variety of equipment. When water is the injection liquid, well fluid 10d is accumulated in separator 20. Produced gas exits the upper end of separator 20 and flows through conduit 22 in the direction of arrow 24 whereupon the produced gas can flow through a back pressure regulator 26 to a gas gathering line represented by arrow 28. Alternatively, the produced gas can flow to compressor 30 and be recycled into the well for gas lift operations. The compressed gas or injection gas exits compressor 30 via conduit 32. Check valve 31 is installed in conduit 32 to prevent injection water from being driven back into compressor 30 in the event compressor 30 is not operating while pump 44 is running.

The liquids in separator 20 flow through conduit 34 to flow treater 36. Oil and water are separated in flow treater 36. The oil is delivered to stock via conduit 38 and the water is delivered to disposal tank 40 via conduit 42.

If oil is the injection liquid, it is only necessary to separate the gas from the oil in separator 20, and therefore the treater 36 is not needed, and instead, the oil flows to the tank 40 from the separator 20, with a part of it going to stock or storage.

A high pressure pump 44 then pumps the injection liquid, whether it is water or oil from the tank 40 via conduit 46 to a junction where it is mixed with injection gas from conduit 32 at a predetermined pressure which is the same or substantially the same as the pressure at which the gas-liquid mixture is introduced into the well. Oil or other liquids such as salt water available at the well site can be used in the gas lift system of the present invention but oil may be preferred to reduce slippage in the injection conduit. By "slippage" is meant the flow of the liquid past the gas on the downward descent. Slippage is reduced when oil is the liquid used because substantial quantities of the gas will be absorbed in solution on the pressure side going in, but will be released on the travel up the production conduit.

Foaming agents such as surfactants are not used so that the gas-liquid mixture does not create a foam. A foam is undesirable for a number of reasons, primarily because they are difficult to break, particularly stable foams such as disclosed in Hutchison U.S. Pat. No. 3,463,231. Therefore, it is difficult to separate and re-use the gas and liquids in a foam even if it could be used for lifting purposes, so that recycling is inhibited or prevented if a foam were used. Further foams must be preformed whereas the gas-liquid mixture used in this invention is mixed right at the well site as it is injected.

As seen in FIG. 1, the combined injection liquid and injection gas from conduits 32 and 46 may be injected into one well bore or several well bores B for gas lift operations therein. As shown in the system X a check valve 47 may be installed after the junction of conduits 32 and 46 adjacent well bore B to prevent spills in the event conduits 32 or 46 rupture. Well fluids **10*d* which are produced from a well bore B are directed via conduit 50 into separator 20**.

The gas lift method is schematically illustrated in FIGS. 2 through 5. FIGS. 2–5 depict a complete gas lift cycle for the gas lift method of the present invention. Although the FIGS. 2 through 5 correspond to system Z, the operation illustrates the principle of this invention for the other embodiments X and Y as well.

Figures 2, 3, 4, 5:
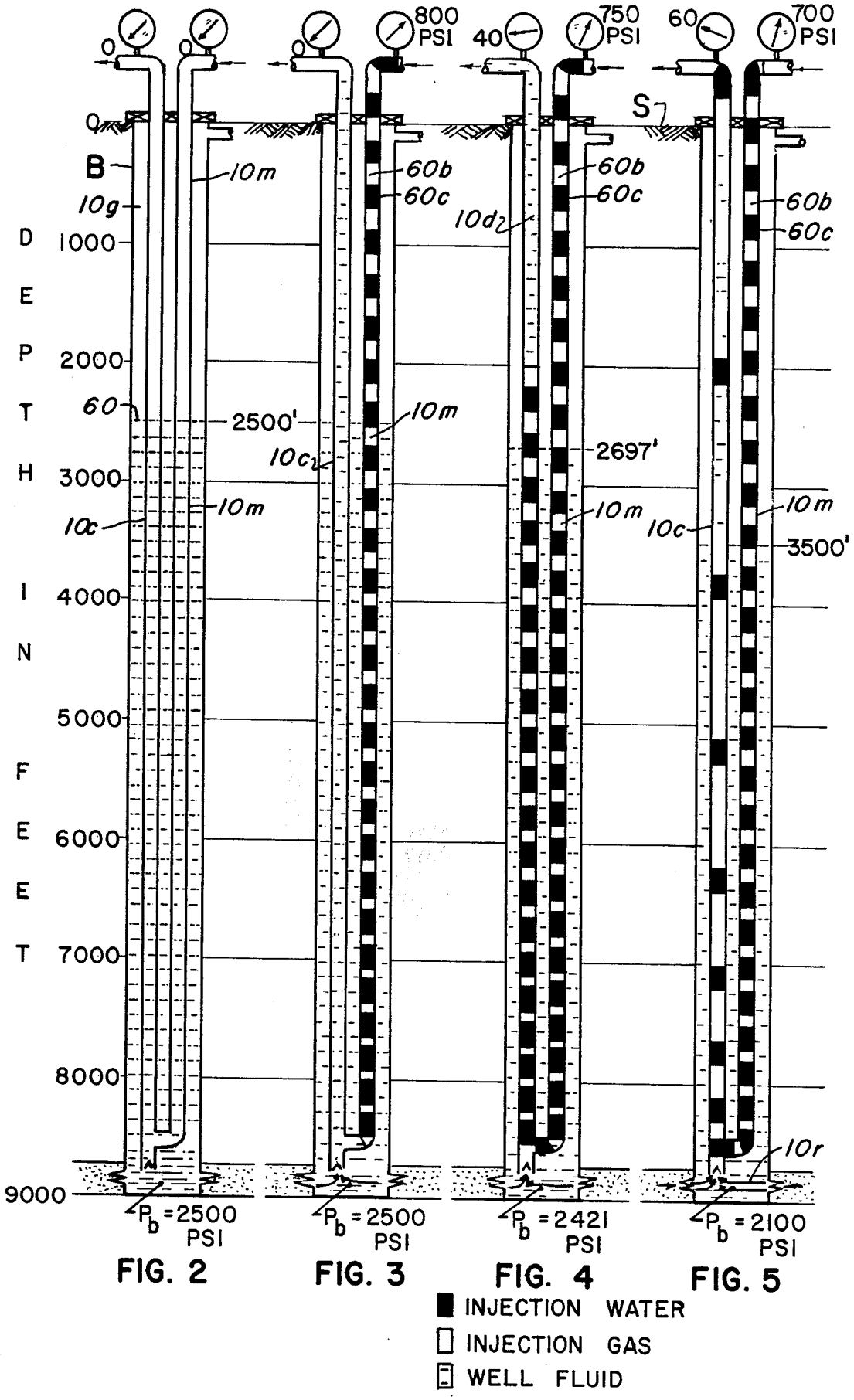
FIG. 2 is a schematic view of the embodiment Z shown at the right hand portion of FIG. 1 showing static well bore conditions before initiation of the gas lift method.
FIG. 3 illustrates schematically the initial injection of the pressurized gas and liquid mixture into an injection conduit thereby displacing well fluid in a production conduit.
FIG. 4 illustrates the use of injected liquid and gas to unload production conduit within a well bore.
FIG. 5 illustrates formation flow into a production conduit as a result of the injected gas and liquid mixture.

Prior to initiation of the gas lift procedure, there is a static liquid level 60 within annulus **10*g* as well as injection tubing 10*m* and production conduit 10*c*. The merged streams from conduits 32 and 46 of FIG. 1 are injected into injection tubing 10m as shown in FIG. 3. The gas and water in injection conduit 10*m* are shown schematically with the lighter segments 60*b* representing the gas phase and the darker segments 60*c* representing the water phase. As the injection gas and liquid travel down the well bore B in injection conduit 10*m* the gas is progressively compressed more and more by the liquid thereabove as the height of the liquid column thereabove increases, as shown by the diminishing size of the lighter segments 60*b* toward the bottom of well bore B. The compression of the gas in the injection liquid in injection tubing 10*m* reaches a maximum at the point of entry into production conduit 10**c because at that point, the maximum column of liquid is acting on the gas.

In embodiments Y and Z in order to minimize separation between the injected gas and liquid as they travel toward the bottom of the well bore, anti-separation devices such as plastic spheres (not shown) can be injected at intervals with the liquid gas mixture to provide longitudinally spaced separators to thereby minimize potential separation of the liquid and gas due to differences in the densities of the injected liquid and gas. This technique can also be used in embodiment X in FIG. 1 but may have a lesser beneficial impact depending on the configuration of the annular injection area.

The highly compressed gas phase expands as it travels up the bore of production conduit **10*c* (FIG. 4) because of the column of liquid thereabove gradually decreasing as the mixture goes up the borehole. This gas expansion provides the work of lift on the well fluid 10*d* in production conduit 10*c* to lift the fluid to surface S as shown in FIG. 4. The net effect of the expanding gas as it rises in production conduit 10*c* is to lower the pressure in the production conduit at the bottom of well bore B. When the pressure reduction during the first or successive cycle of gas-water injection mixture becomes sufficiently great, flow from the formation F into the well bore B and subsequently into production conduit 10*c* will ensue (see FIG. 5). The additional well fluid represented by arrows 10*r* in FIG. 5 will also be lifted through production conduit 10*c*** by the expansive energy of the injected gas.

It should be understood that FIGS. 2–5 are schematic only, because the gas may not separate completely from the liquid as shown. The gas phase is compressed as the mixture goes down the well and expands as the mixture travels up the well, as explained.

A complete cycle as represented by FIGS. 2 through 5 involves an injection of a gas-liquid mixture and the subsequent purging of well fluid **10*d* from production conduit 10*c*** in well bore B, a process called unloading. The rate of injection of the water phase can be decreased when the flow has stabilized. This may be possible after the first cycle of gas-water mixture. Reduction of the water phase brings about an increase in injection gas-water ratio, with a resultant increase in produced fluid. As the production from the well increases the bottom hole pressure will decrease and the work of lift will also increase. The result will be a gradual increase of the pump and compressor discharge pressures to supply the increased lift energy needed. The capacity of the surface equipment may limit the amount that the water rate can be cut back. In such event the water rate should be reduced, commensurate with the rating of the surface equipment. The gas injection rate can then be regulated to provide for peak lift efficiency at the rate being produced. In some wells it may be possible to reduce the water rate to zero and operate on gas alone.

The dual tubing string installation of FIGS. 2 through 5 will be particularly useful in production of low volume, moderate to high pressure wells. In such applications the size of the injection and production tubing can be reduced to permit circulation of relatively low volume rate of gas-water mixture, commensurate with the production capability of the well. The bottom hole pressure can be lowered by adjustment of the gas-water ratio to a value where well fluids enter the production tube readily. Continuous circulation will result in continuous inflow and lift of well fluids.

In wells whose reservoirs are not supported by water drive, water flood or pressure maintenance, the reservoir pressure will gradually decline with continued production.

The dual tubing method will permit efficient lift of such wells until the percentage of submergence declines to where lift by such means is no longer practical. This condition will generally occur late in the life of the well.

Referring to FIG. 1, system Y wherein well fluid **10*d* is displaced from well bore B through annulus 10*g* is used where extremely large volumes of oil and/or water are to be lifted. This is generally made possible by the large cross-sectional area of annulus 10*g*. The advantage of the gas lift method using an injection conduit 10*m* in system Z is that it permits more rapid unloading of the well bore B after startup. Additionally, the slippage of the gas in the water on the downward part of the cycle in injection conduit 10*m*** will be less but the friction losses will be greater. The ready response to surface conditions makes the arrangement shown in the system Z preferable for low to moderate production rates.

Figure 6:
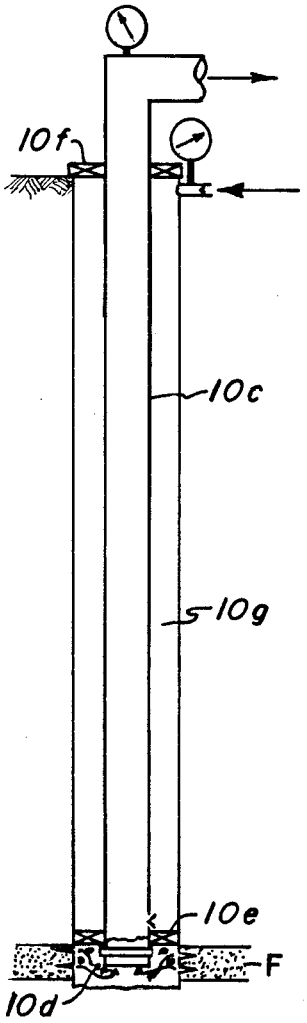
FIG. 6 is a sectional view of the gas lift method of the embodiment X of FIG. 1 using annulus injection.
Figure 7:
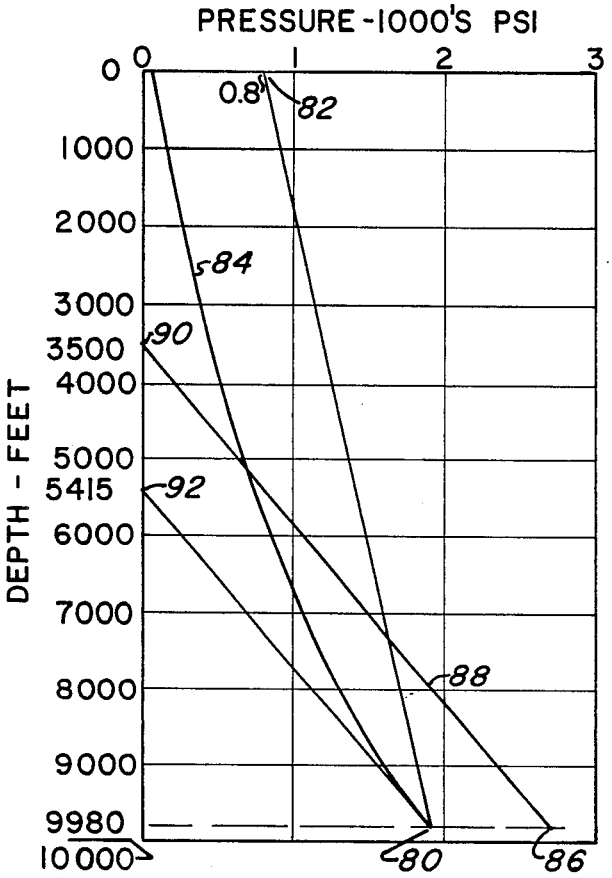
FIG. 7 is a graphical representation of pressure changes within the well during the gas lift operation in the embodiment of the method shown in FIG. 6.
Figure 8:
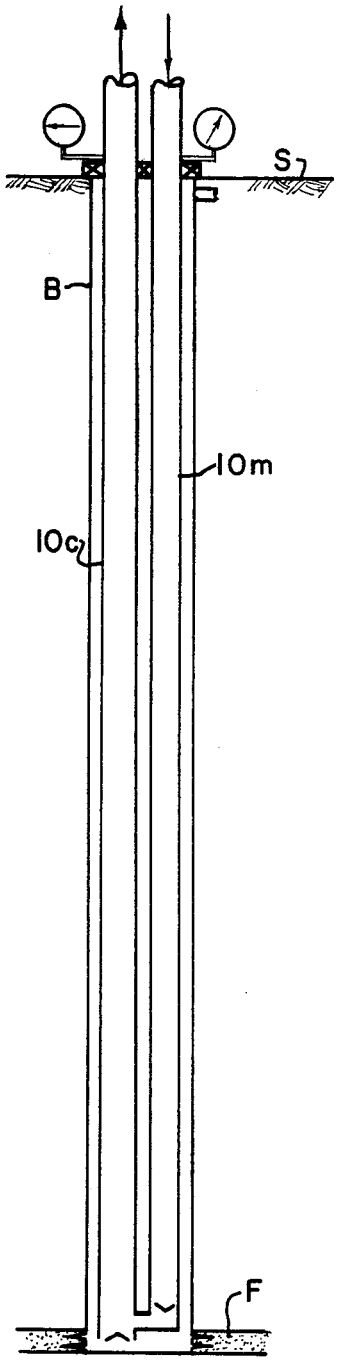
FIG. 8 is a sectional view of the embodiment Z of FIG. 1, showing the use of an injection conduit.
Figure 9:
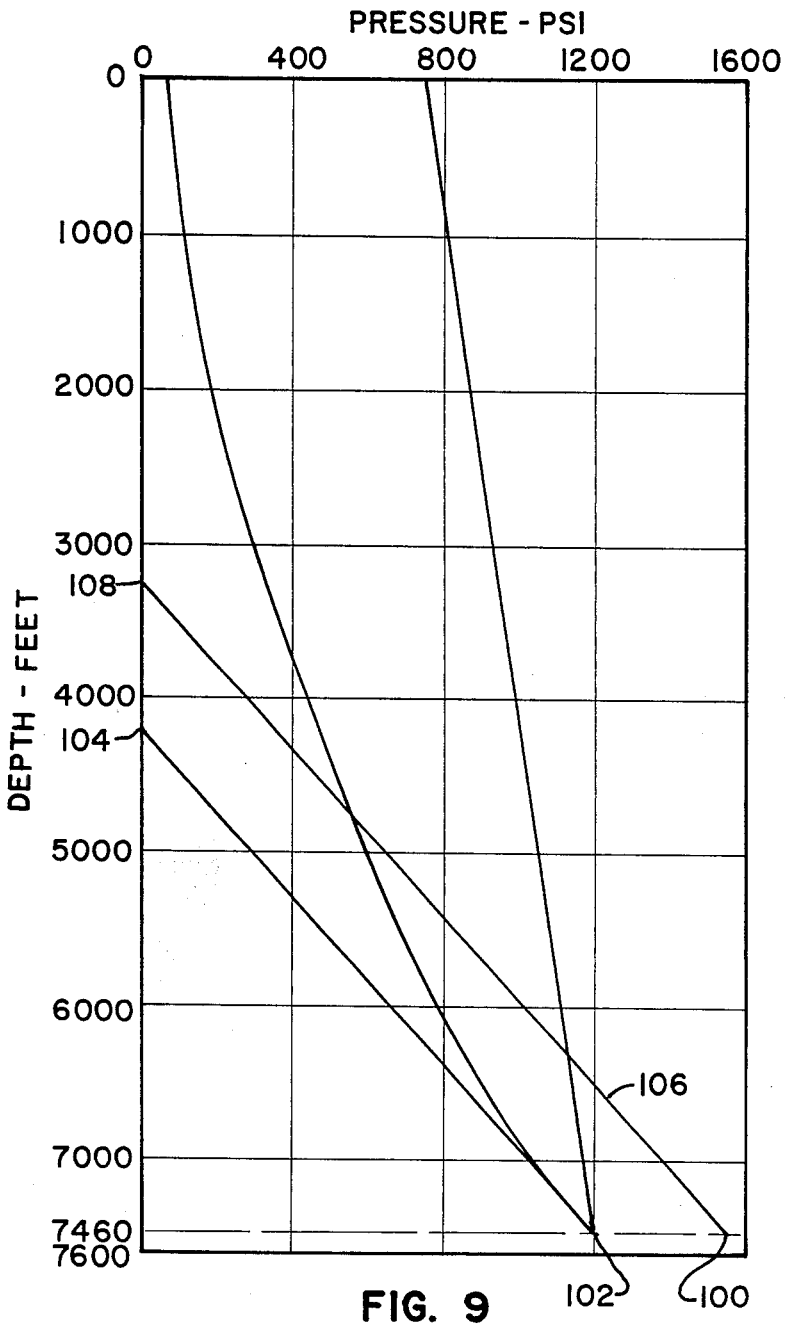
FIG. 9 is a graphical representation of pressure changes within the well using the method of FIG. 8 during gas lift operation.

FIG. 6 is identical to the arrangement within well bore B shown on the left hand side of FIG. 1. FIG. 7 represents graphically the changes in well bore B when the gas lift method of the present invention is utilized. In approaching any gas lift problem for an existing well, certain data regarding the well is already known. Such data includes the static bottom hole pressure, the productivity index of the well (measured in barrels of liquid per day per pound per square inch drop in bottom hole pressure), the percent water cut, as well as other data. From this data, the producing bottom hole pressure at the point of injection to production conduit 10c and the point of lift can be ascertained for any desired production rate. The flowing bottom hole pressure for a given production rate from formation F is shown as point 80 on FIG. 7 and the injection pressure of 800 psi at the surface, shown as point 82 on FIG. 7, define the average pressure gradient in the injection conduit 10g. Knowledge of this gradient allows the rate of injection of water, that will be required to be mixed with a specified volume of injection gas, to be determined in order to maintain the surface injection pressure within the limits of the pump 44 and compressor 30. Normally, such injection pressure is in the range of 600–1200 psi.

Where well fluids 10d are produced through a production conduit 10c as shown in FIGS. 6 and 8, standard two-phase gas lift flow curves are employed to determine their return gradient. The return gradient is illustrated as curve 84 on FIG. 7. The return gradients illustrated in FIGS. 7 and 9 are taken from the "McMurry Hughes, Inc.—Flow Gradient Curves" book.

EXAMPLE FOR INSTALLATION OF FIG. 6

| Assumed Conditions: | |
|---|---|
| Depth of well | 10,550' |
| Tubing | 2⅞" EUE |
| Casing | 5½" od |
| Injection Pressure | 800 psi |
| Wellhead Pressure | 60 psi |
| Separator Pressure | 40 psi |
| Specific Gravity of Gas | 0.60 |
| Bottom hole Temp. | 200° F. |
| Perforations | 10,000' to 10,040' |
| Depth of Injection | 9,980' |
| Static Liquid Level | 3,500' |
| Productivity Index | 0.35 barrels of liquid per day per psi drop in bottom hole pressure |

Percentage oil 50%;
API gravity 35°;
Specific gravity 0.8499
Crude unsaturated; no free gas in reservoir
Specific gravity of produced water 1.08
Injection water = produced salt water
Desired production 140 barrels oil and 140 barrels of water per day = 280 barrels liquid per day or 8.163 gpm

PROCEDURE TO DETERMINE (a) Required gas volume;

(b) Rate of injection of water required (1) Select for first trial injection rate of 120 barrels per day of salt water (SG=1.08) equal to 3.5 gpm.

(2) Specific gravity of produced oil and water equals $$\frac{(140 \text{ barrels oil per day}) \times .8499 + (140 \text{ barrels water per day}) \times 1.08}{280 \text{ barrels liquid per day}} = 0.965$$

(3) Gradient of produced oil and water equals (0.433 psi per foot)×(0.965)=0.4178 psi per foot.

(4) Static bottom hole pressure at 9,980'=(9,980'−3,500)×(0.4178)=2707.5 psi (point 86 on FIG. 7)

(5) Drop in bottom hole pressure due to production = rate of production divided by productivity index =

$$\frac{280 \text{ barrels liquid per day}}{0.35} = 800 \text{ psi}$$

(6) Producing bottom hole pressure equals 2707.5 psi−800 psi=1907.5 psi (see point 80 on FIG. 7).

Accordingly during static conditions the variation of pressure with depth in production conduit 10c is given by curve 88 in FIG. 7. Curve 88 indicates that during static conditions the pressure begins to increase in well bore B as the depth increases from 3,500 feet to the bottom of the well bore B at 9,980 feet. It is understood that the slope of curve 88 is 0.4178 psi per foot. When the gas-liquid mixture described above is introduced into the well bore and circulated back towards the surface S, the density of the fluid in the well bore is reduced or lightened so that the bottom hole pressure is reduced.

The amount of the reduction is governed by the productivity index for any particular well. For an assumed production of 280 bbls liq./day, as in the above example, the reduction of the bottom hole pressure is 800 psi. The drop in bottom hole pressure at 9,980 feet is reflected by point 80 on FIG. 7.

The lowering of bottom hole pressure results in a new and lower producing liquid level from the initial value of 3,500 feet represented by point 90 on FIG. 7. The new producing liquid level in the annulus 10g (FIG. 6) is:

$$3500 \text{ feet} + \frac{800 \text{ psi}}{.4178 \text{ psi/ft}} = 5414.8 \text{ ft.}$$

(represented by point 92 on FIG. 7).

It therefore becomes evident that the gas lift method of this invention will lift the well fluid at the desired rate of production from a depth of 5414.8 feet. It is equally evident that the energy of the fluids in their compressed state in the reservoir from which the well produces will sustain this producing rate in lifting from a depth of 10,000 feet up to this same elevation at 5414.8 feet. Because the well is flowing from lift energy supplied by the gas-liquid mixture, the producing liquid level is lowered below the static liquid level, and with a consequent reduction in bottom hole pressure as reflected by point 80 in FIG. 7. The well's productivity index affixes the drop in bottom hole pressure for a given rate of production.

The percentage submergence is defined by $$\frac{(\text{depth of injection}) - (\text{producing liquid level})}{\text{depth of injection}}$$

-continued $$\frac{(9{,}980 \text{ feet}) - (5{,}414.8 \text{ feet})}{9{,}980 \text{ feet}} \times 100 = 45.7\%.$$

Figure 10:
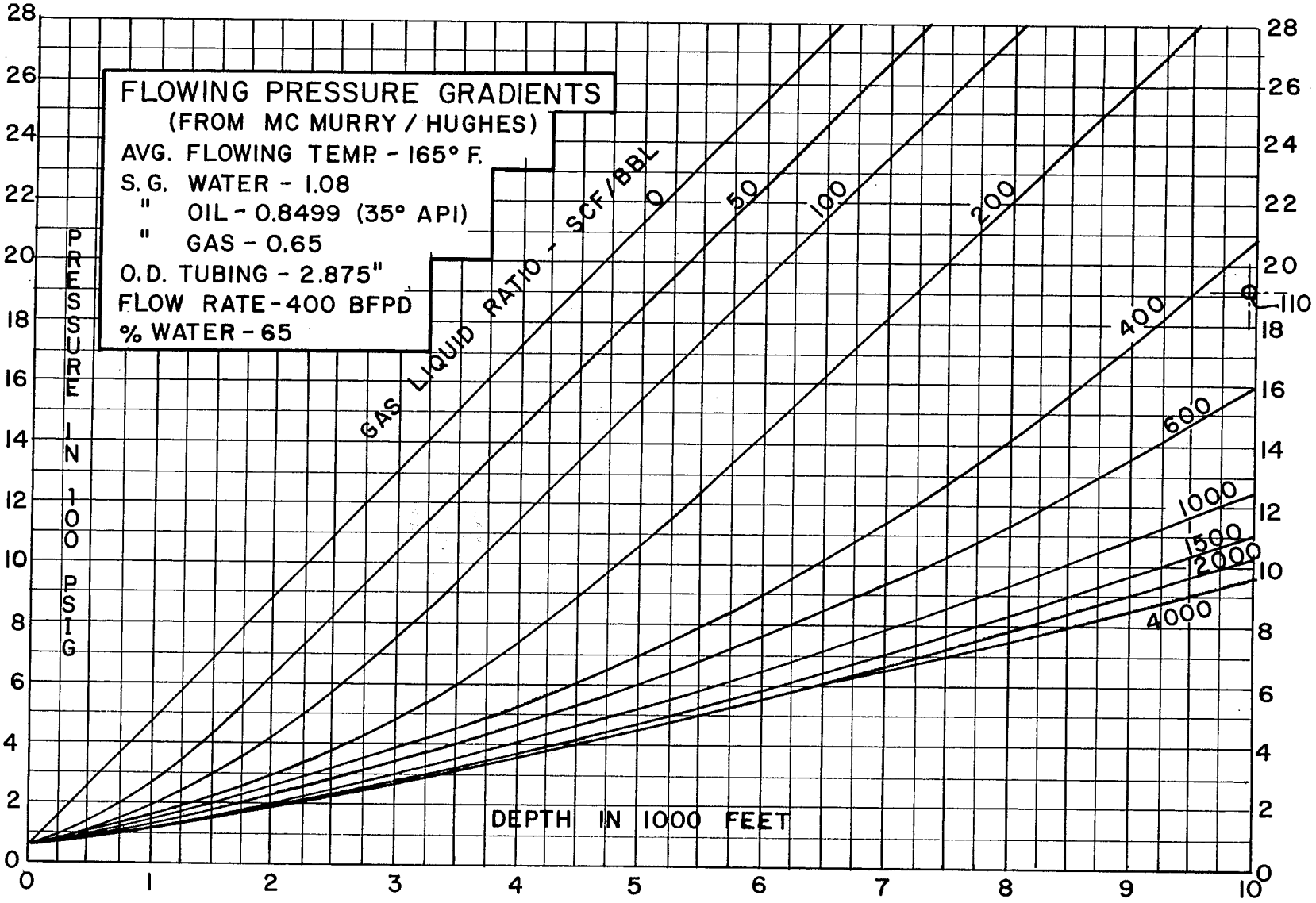
FIG. 10 is a graphical representation of flowing pressure gradients for fixed conditions in 2⅞ inch OD tubing at various depths and pressures taken from McMurry Hughes, Inc. "Flow Gradient Curves" book.

Referring to FIG. 10, the desired ratio of cubic feet of gas per barrel of liquid can be determined. Knowing that 120 barrels of salt water per day are injected and a total production of 280 barrels of liquid per day is desired, it is known that the total production from production conduit 10c will be 400 barrels per day. This condition represents water being 65 percent of the flowing stream in production conduit 10c towards surface S. Since the bottom hole depth and pressure at the bottom of the hole during production of the desired 280 barrels per day of well fluid is known (see pt 110 on FIG. 10), FIG. 10 indicates that a ratio of 470 cubic feet of gas per barrel of liquid is required to maintain the desired production of 280 barrels per day from formation F. The 470 cubic foot of gas per barrel of liquid figure is obtained from interpolation between the curves labeled 400 and 600 on FIG. 10. In the above examples, the specific gravity of the 400 barrels of fluid per day emerging from production conduit 10c is equal to one.

Having found the desired ratio of cubic feet of gas per barrel of liquid and knowing that 400 barrels of liquid per day are produced, the amount of the required gas volume is given by 400 barrels per day times 470 cubic feet of gas per barrel of liquid or 188,000 cubic feet per day or 130.56 cubic feet per minute.

The ratio of the water injected to the volume of gas injected can be increased thereby lowering the injection pressure at the surface S. As can readily be seen, the injection of additional water greatly increases the density of the injected combination of liquid and gas in the annulus 10g thereby decreasing the pressure required at compressor 30 and pump 44 in lifting well fluids 10d to surface S in production conduit 10c. The amount of water added should be regulated in each application so that the injection pressure at surface S is close to but does not exceed the rated capacity of compressor 30 or pump 44. EXAMPLE FOR INSTALLATION OF FIG. 8

FIG. 9 represents schematically and graphically the well conditions during a gas lift operation with system Z (FIG. 1). The assumed well conditions are:

Well depth 7,600 feet.

Perforations 7,480 feet to 7,496 feet.

Pressure of injection of the gas-liquid mixture—750 psi.

Depth of injection 7,460 feet.

Production string of tubing 2⅜ inch EUE.

Injection string of tubing 2.063 inches EUE.

Specific gravity of oil 0.8499 (35° API).

Static oil level (no water) 3,250 feet.

Productivity index 0.5 barrels of oil per day per psi drop in bottom hole pressure.

Bottom hole temperature 210° F.

Wellhead pressure 60 pounds per square inch.

Separator pressure 80 pounds per square inch.

Specific gravity of injection water 1.06.

Desired production 175 barrels of oil per day or 5.10 gpm.

Gas gravity 0.65.

PROCEDURE TO DETERMINE (a) Gas volume to be injected; and (b) Injection water rate for injection pressure of 750 psi for the water and gas mixture.

(1) Gradient due to 35° oil=0.8499(0.433)=0.368 psi/ft.

(2) Static bottom hole pressure at 7,460′=(7460−3250)(0.368)=1549.28 psi (point 100 on FIG. 9)

(3) Select 25 barrels per day as injection rate for salt water =0.729 gallons per minute.

(4) Specific gravity of oil-water mixture equals $$\frac{175(.8499) + 25(1.06)}{200} = 0.876$$

(5) Producing bottom hole pressure at $$7{,}460' = 1549.28 - \frac{175}{0.5}$$

$$= 1549.28 - 350 = 1199.28 \text{ psi}$$

(point 102 on FIG. 9)

(6) Producing liquid level (equals point of lift) =

$$3250 + \frac{350}{.368} = 4201.08$$

(point 104 on FIG. 9)

As in the previous example, curve 106 illustrates the increase in pressure with depth beginning at zero pressure at the initial liquid level of 3,250 feet given by point 108 on FIG. 9 and using a gradient of 0.368 pounds per square inch per foot to arrive at point 100 on FIG. 9. As shown in FIG. 9, after production of 175 barrels of oil per day is initiated from the formation F the bottom hole pressure drops at the 7,460 foot level from 1,549.28 psi to 1,199.28 psi as indicated by point 100 and point 102, respectively. Accordingly, with the bottom hole pressure reduced to 1,199.28 psi and further employing the gradient of 0.368 pounds per square inch per foot it can be seen on point 104 on FIG. 9 that the producing liquid level will be lowered from 3,250 feet to 4,201.08 feet as represented by point 108 and point 104, respectively.

Figure 11:
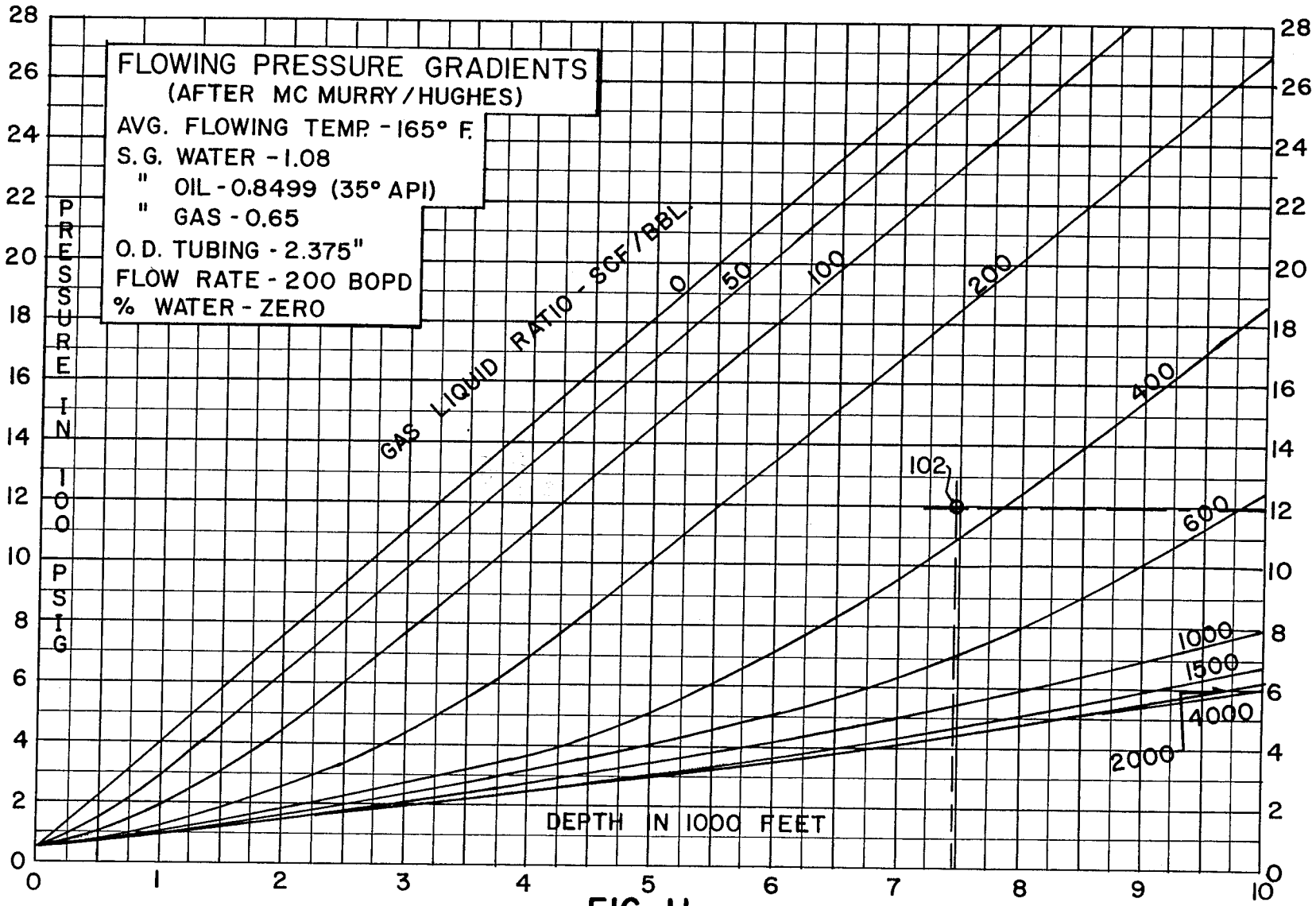
FIG. 11 is a graphical representation of flowing pressure gradients using fixed conditions such as zero percent water produced in 2⅜ inch tubing at various depths and pressures taken from McMurry Hughes, Inc. "Flow Gradient Curves" book.
Figure 12:
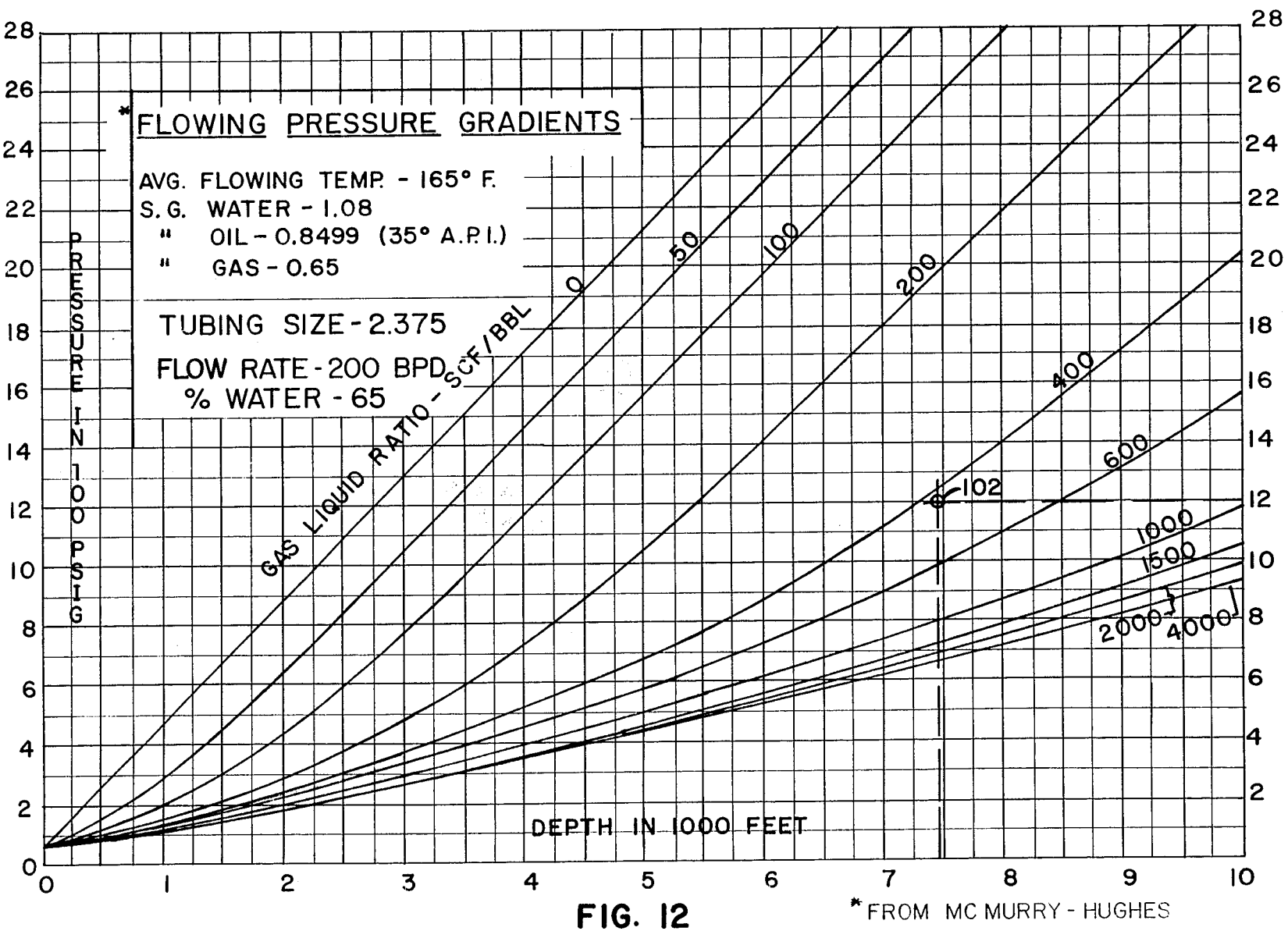
FIG. 12 is a graphical representation of flowing pressure gradients using fixed conditions such as sixty-five percent water produced for 2⅜ inch tubing at various depths and pressures taken from McMurry Hughes, Inc. "Flow Gradient Curves" book.

Next, knowing that 175 barrels of oil are desired to be produced and that 25 barrels per day of injection water is also used, FIGS. 11 and 12 can be used to determine the ratio of standard cubic feet of injection gas required per barrel of production. It should be noted that FIG. 11 is based upon zero percent water produced and FIG. 12 is based upon sixty-five percent water being produced. Since 25 barrels per day are injected, the actual initial ratio of gas per barrel produced will comprise of an interpolation between FIGS. 11 and 12 weighted towards FIG. 11 since in effect the injection of 25 barrel per day of water will result in 12½ percent water being produced in production conduit 10c. Accordingly, referring to FIG. 11 it can be seen that the intersection of 1,199.28 psi at 7,460 feet (which is represented by point 102 on FIGS. 9, 11 and 12) translates to approximately 372 standard cubic feet a day per barrel on FIG. 11 and roughly 440 cubic feet a day per barrel on FIG. 12. The gas-liquid ratio may then be calculated:

$$\text{Gas-liquid ratio} = \frac{(\text{Barrels oil per day} \times 372) + (\text{Barrels water per day} \times 440)}{\text{Barrels oil per day} + \text{Barrels water per day}}$$

$$= \frac{175(372) + 25(440)}{200} =$$

-continued 380 standard cu. ft. per barrel

Finally, the ratio is multiplied by the total production of 200 barrels per day to yield 76,000 cubic feet per day or 52.78 cubic feet per minute.

As in the previous example, the ratio of water to gas can be controlled to regulate the injection pressure of the water-gas mixture at the surface S to a pressure below the rated pressures of pump 44 or compressor 30. The mixing of the gas and water occurs at the surface S at the point where the flow lines 32 and 46 join as shown in FIG. 1, so that mixing of the gas and water is at substantially the same pressure as the injection pressure of the gas-oil mixture as it is introduced into the well.

Since data of the type shown in FIGS. 10 through 12 is not available for the annulus flow system Y, the analysis in that type of a gas lift operation involves a presumption of an overall system efficiency which equals the gas lift work output divided by the total compressor and pump horsepower input. Having assumed an efficiency, e.g. thirty percent (30%), an initial starting level of injection water is selected and the calculations proceed as per the examples given above. As before the ratio of water to gas is varied to control the injection pressure at the surface to below the rated limits of pump 44 and compressor 30. However, the efficiencies achieved in production of well fluids through annulus **10*g* will be considerably lower than for those attained in systems X and Z, wherein production is through tubing. Because of the larger cross-sectional area of annulus 10*g* as compared to the injection conduit 10*m* in system Y, greater amounts of injection gas should be required to transport the well fluid 10*d* to opening 10*k* in casing 10*a*. However, applying the gas lift technique for producing well fluid 10*d* through annulus 10*g* has the advantage of allowing production of greater quantities of well fluid 10*d* from formation F than the gas lift systems X and Z wherein well fluids are produced from production conduit 10*c***.

On start-up or during unloading, the discharge pressure of the compressor 30 and pump 44, otherwise called the surface injection pressure, will generally rise as the gasified mixture travels down the injection conduit **10*m* or annulus 10*g*. The pressure will reach a maximum as the mixture reaches the bottom and starts its upward travel through the production conduit 10*c* in systems X and Z, or through the annulus 10*g* in system Y. Up until this time, the surface injection pressure rises because the gasified fluid inside the injection conduit is lighter than the initial well fluid being displaced through the production conduit. For those instances where the surface injection pressure rises above the pressure rating of the compressor 30 and or pump 44, gas injection must be stopped until sufficient water has been pumped to bring the pressure down. When the well is next unloaded, the rate of gas injection can be decreased throughout the first cycle. The first cycle can actually be achieved using half compressor capacity and then subsequently reinstating full compressor capacity operation. Although most wells can be unloaded without exceeding the rating of the surface equipment, if such a problem arises, the well can be unloaded for the first cycle by decreasing the gas rate or increasing the pump rate or both. It is within the purview of the present invention to automate the control of gas volume and pressure and water volume and pressure automatically to avoid exceeding the rated capacities of the injection compressor 30 or pump 44**.

Accordingly, the gas lift method of the present invention offers many advantages over that of known conventional gas lift systems. Some of these advantages are: no gas lift valves are required for unloading of a well; no gas lift valves or other contrivances are required to compensate for changing well conditions; no investment or expenditure of funds for valve replacement and or repair is required; maximum submergence for any producing rate is assured at any point of lift (this means maximum lift efficiency will also result with minimum expenditure for plant horsepower); and corrosion and/or scale inhibitors can be introduced into the injection water for easy protection.

Applicant's method of gas lift can be applied either to flowing or to non-flowing wells. The examples which have been presented for lifting of non-flowing well apply equally to flowing wells.

In conventional gas lift systems employing gas alone as the lifting medium and gas lift valves, spacing between the gas lift valves must by their nature decrease with depth. Hence, there is a limit to the number of valves that can be run for a given installation as well as depth to which they can be run for a given surface injection pressure. With the gas lift system of the present invention, no such limitations exist. Finally, the gas lift system of the present invention has no valves to pop open at depths where such valves are not supposed to open. Instead, only one port exists for entry of injection fluid to the production conduit.

The foregoing disclosure and description of the invention are illustrative and explanatory thereof, and various changes in the size, shape and materials, as well as in the details of the illustrated construction may be made without departing from the spirit of the invention.

I claim:

1. A gas lift method for lifting fluid from a borehole to the surface, comprising the steps of:

mixing at the surface a pressurized injection gas with a presssurized injetion liquid without any foaming substance to form a gas-liquid pressurized non-foam mixture at a predetermined pressure less than the pressure at the bottom of the borehole; said gas having a different composition than said liquid;

introducing said pressurized mixture into a first elongate portion of said borehole substantially at said predetermined pressure and flowing the mixture to a point down in the borehole to cause the gas to become gradually compressed more and more as the height of the gas-liquid column thereabove increases;

then flowing the non-foam gas-liquid mixture at said point into a second elongate portion of the borehole which communicates with the surface to allow the gas to then gradually expand in and displace said well fluid upwardly towards the upper end of said borehole, thereby reducing the density of the well fluid in the second elongate portion and lowering the bottom hole pressure in the well; and continuing the flow of the gas-liquid mixture into the first elongate portion to cause the continuing flow into the second elongate portion of said borehole with further lowering of bottom hole pressure and resultant flow of said well fluid to the surface from the well bore through said second elongate portion with resultant stabilization of the bottom hole pressure.

2. The method of claim 1, wherein:
the liquid in said mixture is oil; and
the gas in said mixture is air.

3. A gas lift method for lifting fluid from a borehole to the surface, comprising the steps of:

mixing at the surface a pressurized injection gas with a pressurized injection liquid without any foaming substance to form a gas-liquid pressurized non-foam mixture at a predetermined pressure less than the pressure at the bottom of the borehole;

introducing said pressurized mixture into a first elongate portion of said borehole substantially at said predetermined pressure and flowing the mixture to a point down in the borehole to cause the gas to become gradually compressed more and more as the height of the gas-liquid column thereabove increase;

then flowing the non-foam gas-liquid mixture at said point into a second elongate portion of the borehole which communicates with the surface to allow the gas to then gradually expand in and displace said well fluid upwardly towards the upper end of said borehole, thereby reducing the density of the well fluid in the second elongate portion and lowering the bottom hole pressure in the well;

continuing the flow of the gas-liquid mixture into the first elongate portion to cause the continuing flow into the second elongate portion of said borehole with further lowering of bottom hole pressure and resultant flow of said well fluid to the surface from the well bore through said second elongate portion with resultant stabilization of the bottom hole pressure;

separating the well fluid lifted from said well bore into a gas phase and liquid phase;

pressurizing a portion of the gas phase for use as an injection gas in the mixture step;

separating the liquid phase into a petroleum phase of the produced well fluid and a phase of the injection liquid; and thereafter pressurizing a portion of said injection liquid and mixing it with the pressurized gas as in said mixing step and recycling said gas and liquid back into the well bore to repeat the foregoing step.

4. The method of claim 3, wherein:
said first elongate portion is an annulus around said second elongate portion;
said second elongate portion is an outlet conduit; and
said point down in the borehole is determined by an opening in the outlet conduit which communicates with said annulus.

5. The method of claim 4, further including the steps of:

sealing off said annulus formed between said outlet conduit and the well bore at the surface and below the opening in the outlet conduit;

injecting said mixture of pressurized injection liquid and gas into said annulus adjacent the upper end of said well bore;

forcing said mixture of injected gas and liquid to said opening in said outlet conduit; and injecting said mixture of injected gas and liquid into said outlet conduit.

6. The method of claim 3, wherein:
said first elongate portion is an inlet conduit;
said second elongate portion is an outlet conduit; and
said point down in the borehole is determined by an opening in the outlet conduit which communicates with said inlet conduit.

7. The method of claim 6, further including the steps of:

sealing off said annulus formed between said conduits and the well bore at the surface;

injecting said mixture of pressurized injection liquid and gas into said inlet conduit adjacent the upper end of said well bore;

forcing said mixture of injected gas and liquid to said opening in said outlet conduit; and injecting said mixture of injected gas and liquid into said outlet conduit.

8. The method of claim 3, wherein:
said first elongate portion is an inlet conduit;
said second elongate portion is an annulus; and
said point down in the borehole is determined by an opening in the inlet conduit which communicates with the annulus.

9. The method of claim 8, further including the steps of:

sealing off said annulus formed between said inlet conduit and the well bore at the surfaces and below the opening in the inlet conduit which communicates with the annulus;

injecting said mixture of pressurized injection liquid and gas into said inlet conduit adjacent the upper end of said well bore;

forcing said mixture of injected gas and liquid to said opening in said inlet conduit; and injecting said mixture of injected gas and liquid into said annulus.

10. The method of clalim 3, wherein:
the liquid in said mixture is oil.

* * * * *